United States Patent [19]

Mizuno

[11] Patent Number: 4,920,849

[45] Date of Patent: May 1, 1990

[54] AUTOMATIC PERFORMANCE APPARATUS FOR AN ELECTRONIC MUSICAL INSTRUMENT

[75] Inventor: Kotaro Mizuno, Hamamatsu, Japan

[73] Assignee: Yamaha Corporation, Hamamatsu, Japan

[21] Appl. No.: 293,938

[22] Filed: Jan. 5, 1989

[30] Foreign Application Priority Data

Jan. 6, 1988 [JP] Japan ..... 63-271

[51] Int. Cl.[5] ..... G10H 1/38; G10H 7/00

[52] U.S. Cl. ..... 84/613; 84/637; 84/DIG. 22

[58] Field of Search ..... 84/1.01, 1.03, 1.17, 84/1.24, 1.28, DIG. 12, DIG. 22, 613, 637, 650–652, 669

[56] References Cited

U.S. PATENT DOCUMENTS 4,587,878 5/1986 Nakada et al. .

FOREIGN PATENT DOCUMENTS 62-187388 8/1987 Japan .

*Primary Examiner*—Stanley J. Witkowski

*Attorney, Agent, or Firm*—Spensley Horn Jubas & Lubitz

[57] ABSTRACT

An automatic performance apparatus which records a performance state in the form of performance data in a storage means, and plays back a performance based on the performance data read out from the storage means In a record mode, a chord detection means discriminates whether or not a chord has been established. If a chord has been established, then chord information is written in memory. If a chord has not been established, then tone information including key-on information or a note portion of key-on information, excluding octave information, is written in memory. The automatic performance apparatus enables the use of a storage means having a greatly reduced storage capacity as compared to a prior art one, and pitch or note information designated at a keyboard or the like are recorded/played back as performance data without modification.

3 Claims, 7 Drawing Sheets

| KEY | $C_{-1}$ --- $C_0$ --- $C_2$ $C_2^{\#}$ --- $B_2$ $C_3$ --- $C_4$ --- $C_6$ --- $C_8$ |
|---|---|
| KEY CODE | 12 --- 24 --- 48 49 --- 59 60 --- 72 --- 96 --- 120 |

AUTOMATIC PERFORMANCE APPARATUS FOR AN ELECTRONIC MUSICAL INSTRUMENT

BACKGROUND OF THE INVENTION

1. Field of the Invention

The present invention relates to an automatic performance apparatus which makes an automatic performance (play) on the basis of performance data recorded (written) in advance in a storage means such as a memory by a player and, more particularly, to an automatic performance apparatus which, during recording, detects a chord on the basis of pitch information outputted from a pitch designation means such as a keyboard and stores chord information as performance data if a chord is established, and records information associated with the pitch information when a chord cannot be established.

2. Description of the Prior Art

There has heretofore been known an electronic musical instrument with an automatic performance apparatus, which records/plays back a chord as a chord name (root+chord type) together with a tone duration or tone generation timing information as performance data, as disclosed in Japanese Patent Laid-Open (Kokai) No. 62-187388.

The automatic performance apparatus can greatly reduce a storage capacity of, e.g., a memory as compared to a case wherein a plurality of pitches (octave+note) or notes designated by, e.g., a keyboard are recorded/played back as performance data.

However, when performance data is written, the automatic performance apparatus described in the above patent as an embodiment discriminates that a chord is established only when the apparatus can determine key-on tones as a chord, and writes chord information. When the apparatus cannot discriminate a chord, it determines that a chord cannot be established, and does not record information of the key-on tones. For this reason, the automatic performance apparatus described in the above patent can only record/play back chords which can be discriminated.

Recently, a player freely uses various kinds of chords more than those which can be discriminated by the apparatus. Thus, chords which cannot be discriminated by the apparatus are preferably recorded/played back.

SUMMARY OF THE INVENTION

The present invention has been made in consideration of the conventional problems and has as its object to provide an automatic performance apparatus which records/plays back chord information as performance data, and can record/play back a combination of tones which cannot be discriminated by the apparatus as a chord (when a chord cannot be established).

In order to achieve the above object, according to the present invention, there is provided an automatic performance apparatus comprising: pitch designation means; chord detection means for discriminating based on one or a plurality of pieces of pitch information outputted from the pitch designation means whether or not a chord is established, and for, when the chord is established, generating chord information; writing means for, when the chord is established in a record mode, writing the chord information in the storage means and for, when the chord cannot be established, writing information associated with the pitch information in the storage means; and readout means for reading out the information written in the storage means and controlling generation of tones in a play mode.

As described above, according to the present invention, in the record mode, when the apparatus can discriminate a combination of designated pitches as a chord, the chord information (chord name) is recorded in the storage means. When the apparatus cannot discriminate the combination of pitches as a chord, it records information associated with the pitch. As the information associated with the pitch, some or all pieces of key-on information (i.e., key code or pitch information) at a keyboard as the pitch designation means or information of only a note portion excluding octave information from the key-on information can be used. In the play mode, the readout means reads out the chord and pitch information from the storage means and controls generation of tones.

According to the present invention, when a chord is established, chord information (chord name=root+type) is recorded to reduce a storage capacity. If a chord which cannot be discriminated is generated (i.e., when the apparatus determines that a chord cannot be established), information of constituting tones or associated therewith is recorded, so that a playback operation (automatic performance) can be made. Therefore, recent various chord types can be coped with.

DETAILED DESCRIPTION OF THE PREFERRED EMBODIMENT

An embodiment of the present invention will now be described with reference to the accompanying drawings.

Figures 1, 2:
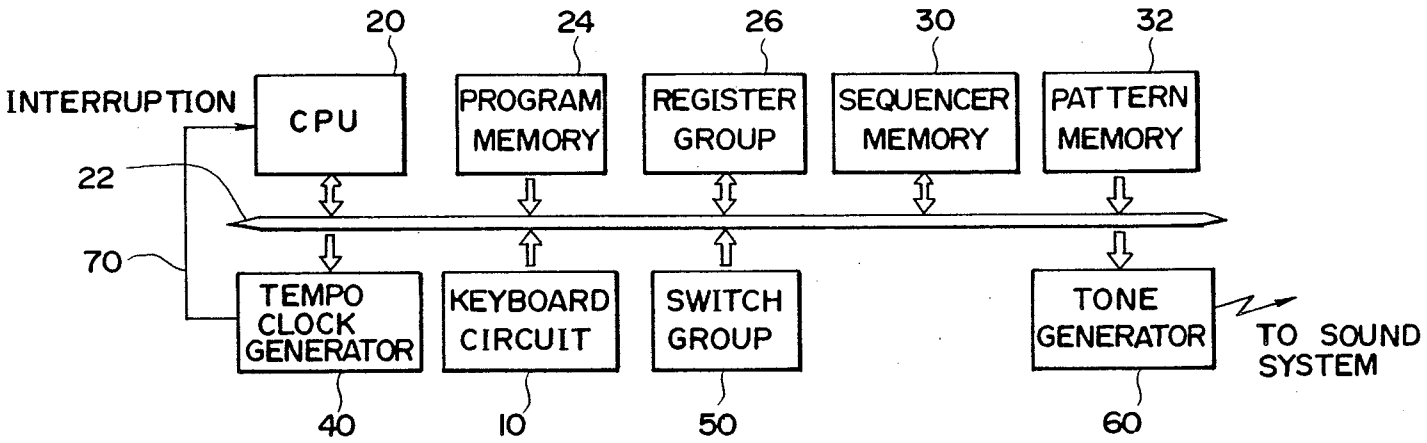
FIG. 1 is a block diagram showing a hardware arrangement of an electronic musical instrument according to an embodiment of the present invention.
FIG. 2 is a table showing a correspondence between keys and key codes in a keyboard circuit shown in FIG. 1.

FIG. 1 shows a hardware arrangement of an electronic musical instrument to which an automatic performance apparatus according to an embodiment of the present invention is applied. The electronic musical instrument has a normal performance mode for generating performance tones as keys at the keyboard are operated, and a sequencer mode for recording/playing back key operations at the keyboard. In the sequencer mode, chord and bass automatic performance operations are made based on a chord designated by the key operations according to an accompaniment pattern corresponding to rhythm. (Description of Arrangement of Electronic Musical Instrument in FIG. 1)

In FIG. 1, a keyboard circuit 10 detects depression of a key at a keyboard (not shown), and generates key information (key code) representing the depressed key. The key code complies with the MIDI (Musical Instrument Digital Interface) standards. As shown in FIG. 2, the key codes are obtained by assigning integer multiples of 12 (indicated by decimal notation), e.g., 36, 48,..., 96 to respective C tones, and values, which are incremented by one as a tone sharps, to the remaining keys in correspondence with positions $C_1$, $C\#_1$, $D_1$,..., $B_1$, $C_2$,..., $C_6$ of depressed keys. A rest, i.e., a (key) code representing a state wherein none of the keys is depressed is represented by "0". In the following description, the numerical value data such as key codes are indicated by the decimal notation unless otherwise specified.

The overall operation of the electronic musical instrument shown in FIG. 1 is controlled by using a central processing unit (CPU) 20. The CPU 20 is connected to the keyboard circuit 10, a program memory 24, a register group 26, a sequencer memory 30, a pattern memory 32, a clock generator 40, a switch group 50, and a tone generator 60. The tone generator 60 is connected to a sound system consisting of an amplifier, loudspeakers, and the like although not shown. The clock pulse output terminal of the clock generator 40 is connected to the interrupt signal input terminal of the CPU 20 through a signal line 70.

The program memory 24 comprises a ROM, and stores various control programs of main routine processing, tempo clock interruption processing, third subroutines, and the like corresponding to the flow charts shown in FIGS. 5 to 9.

The register group 26 temporarily stores various data generated when the CPU 20 executes the control programs, and includes the following registers set in a RAM. In the following description, the registers and their contents (data or the like) are represented by identical label names unless otherwise specified.

TCLK: tempo clock

TCLK indicates a progression position of an auto rhythm in one measure and varies in the range of 0 to 95.

MODE: mode

0: normal (normal performance) mode

1: sequencer play mode

2: sequencer write (record) mode

RUN: rhythm run flag

0: rhythm stop state

1: rhythm run state

PNT: address pointer

PNT is used for read/write access of sequencer.

ADRS: address pointer

ADRS is used for read access of pattern memory and varies in the range of 0 to 31

$KCBUF_0$ to $KCBUF_7$: chord name upper 4 bits: chord type lower 4 bits: root

TYPE: chord type

TYPE represents chord types (M (major), m (minor), 7th (seventh), m7 (minor seventh),...) by values 0 to 6. "7" represents that a chord cannot be established.

ROOT: root of chord

ROOT represents note codes (e.g., C, C#, D,..., B) by values 0 to 11. When a chord cannot be established (TYPE=7), ROOT represents a lowest tone of key-on tones $KCBUF_0$ to $KCBUF_7$.

CHDFLG: chord change flag

CHDFLG is set when a chord is changed in the record mode (MODE=2).

$KY_1$ to $KY_4$: key code register $KY_1$ to $KY_4$ store four tones from a high-tone side of key-on tones as interval differences (only note information, 0 to 11) from the root ROOT.

RHY: rhythm number rhythm type

IVTFLG: event flag

IVTFLG is set when an event occurs in the record mode (MODE=2).

The sequencer memory 30 comprises a RAM, and a player can write desired performance data therein. The performance data is an appropriate combination of chord established state data (1 word=2 bytes), chord non-established state data (1 word=4 bytes), an end mark (1 word=2 bytes), a bar line (1 word=1 byte), and other control information (1 word=2 bytes or more) (tone volume data, rhythm selection data, and the like). The performance data is recorded at a sixteenth note resolution, and its write/read access is executed every six tempo clocks TCLK.

The first byte of the chord established state data represents a tone generation timing, and its second byte represents a chord name CHD. As timing data, integer multiples of 6 corresponding to the sixteenth note of the value 0 to 95 of the tempo clocks TCLK are recorded. The upper 4 bits of the chord name data CHD correspond to the chord type TYPE, and lower 4 bits correspond to the root ROOT. The chord type TYPE data varies between 0 and 6 as described above, and its most significant bit (MSB) is "0".

The first byte of the chord non-established state data is the same tone generation timing data as described above. The upper 4 bits of the second byte of this data are data "$1000_B$ ($=8_H$)" (in the following description, binary notation is represented by suffix "$_B$", and hexadecimal notation is represented by suffix "$_H$") representing that a chord cannot be established, and its lower 4 bits are root data. When a chord cannot be established, the lowest tone is recorded as the root ROOT. Each of the third and fourth bytes of the data can record two 4-bit note data. That is, a total of four note data $KEY_1$ to $KEY_4$ can be recorded. As the note data $KEY_1$ to $KEY_4$, four tones from the high-tone side of the key-on tones are selected, and differences between these key-on tones (key codes) and the root ROOT (the number of halftones) are recorded as values (0 to 11) within one octave. If the number of key-on tones is less than 4, "15 ($=F_H$)" is recorded in a corresponding one of the areas $KEY_1$ to $KEY_4$.

The first byte of the end mark is timing data, and the second byte is data $FE_H$ representing an end of performance data. The bar line is data $FF_H$. The first byte of other control information is timing data. The second byte of the control information is data whose value varies between $90_H$ and $FD_H$, and the upper 4 bits of the second byte correspond to an identification mark representing the type of data. The lower 4 bits of the second byte and bits from the third byte are "data" representing the contents of control.

Figure 4A:
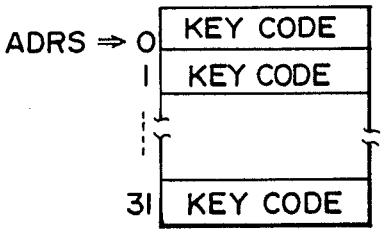
FIGS. 4A and 4B show data formats of a sequencer memory shown in FIG. 1.
Figure 4B:
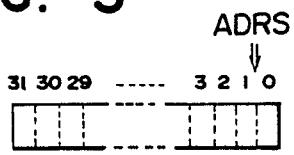

The pattern memory 32 comprises a ROM, and stores rhythm patterns, chord patterns, and bass patterns. As the rhythm patterns, a normal pattern and variation patterns are prepared for each rhythm type, and are recorded at a resolution 1/96 of a measure in quadruple time. Each rhythm pattern is recorded as on/off ("1"/"0") data at each timing of a 1/96 period of one measure for each of a plurality of rhythm tones (percussion types), and is read out every count of the tempo clocks TCLK. A number of types of patterns equal to (the number of chord types)×(the number of rhythm patterns) are prepared for each of the bass and chord patterns. These patterns are recorded at a thirty-second note resolution. When these patterns are read out, data designated by the address pointer ADRS which is incremented every 3 counts of the tempo clocks TCLK is read out. Each bass pattern consists of 32-byte key codes for each measure, and the key codes in C are recorded, as shown in FIG. 4A. One chord pattern consists of 32-bit on/off data for each measure, as shown in FIG. 4B. Each on/off data represents a tone generation state at a timing corresponding to one thirty-second note.

The tempo clock generator 40 is a combination of a variable frequency oscillator or frequency-fixed oscillator, and a frequency divider with a variable frequency division ratio. The generator 40 generates clock pulses every 1/96 period of one measure in quadruple time in accordance with a preset tempo. The clock pulses are inputted to the CPU 20 through the signal line 70 as an interruption signal.

The switch group 50 comprises various operation switches arranged on an operation panel (not shown), e.g., a mode selection switch for setting an operation mode such as a sequencer write/read mode, and the like, a start/stop switch for designating start and stop of an automatic performance, a rhythm selection switch, a tone volume switch, and the like.

The tone generator 60 comprises a plurality of tone forming channels including a 0th channel for a bass tone and 1st to 4th channels for forming chord tones. The tone generator 60 forms a tone signal based on key-on data, key-off data, tone color (or instrument type) data, pitch data, and the like supplied from the CPU 20, and supplies the signal to a sound system (not shown) comprising an amplifier, loudspeakers, and the like. The sound system generates tones based on the tone signal.

(Description of Operation of Electronic Musical Instrument in FIG. 1)

The operation of the electronic musical instrument shown in FIG. 1 will be described below with reference to the flow charts shown in FIGS. 5 to 9.

When the electronic musical instrument is powered, the CPU 20 starts an operation in accordance with a control program stored in the program memory 24. First, the CPU 20 executes processing of the main routine from step 100 in FIG. 5, and also executes tempo interruption processing shown in FIG. 6.

1. Main Routine Processing

Figure 5:
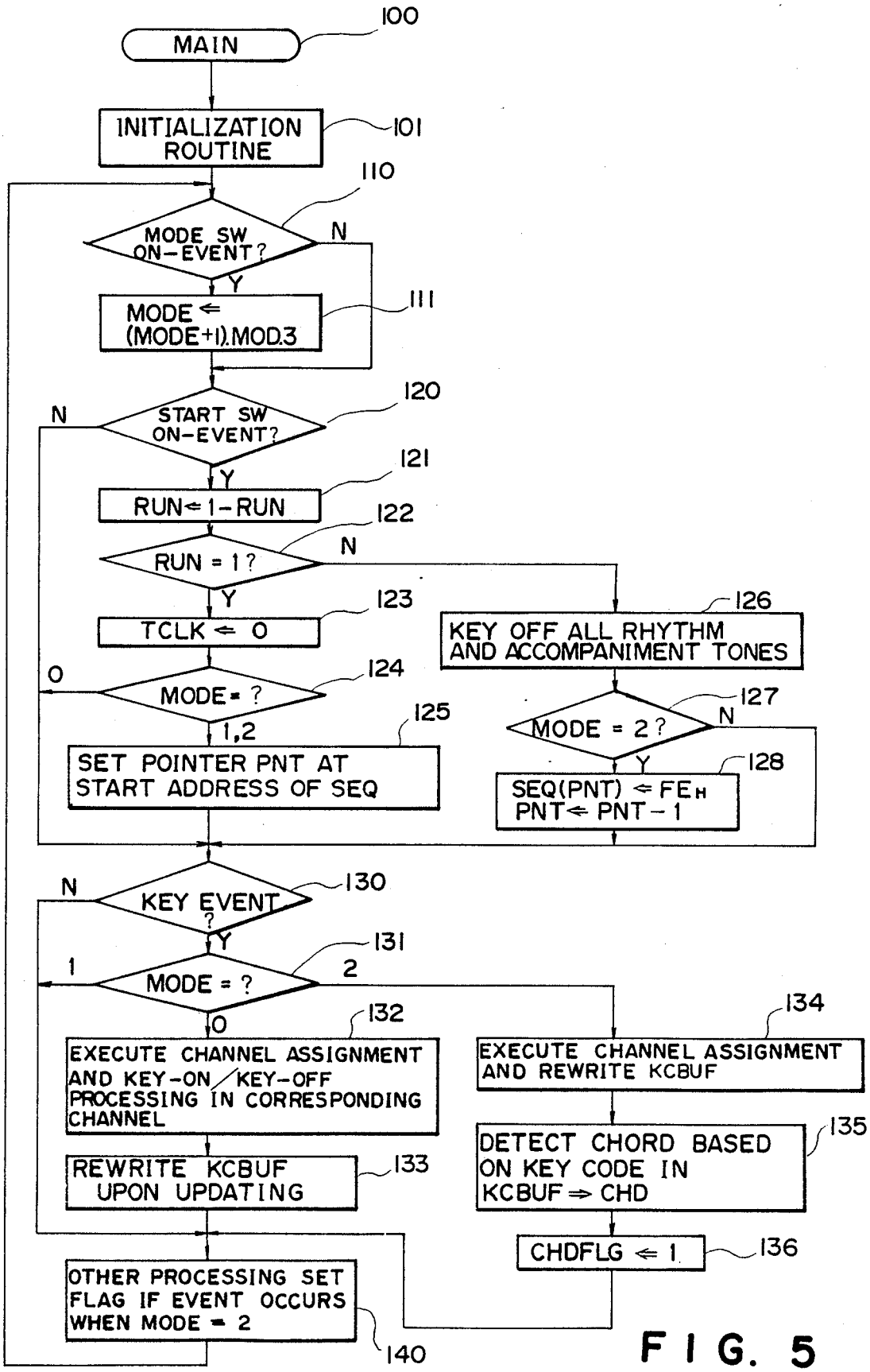
FIG. 5 is a flow chart of main processing of the electronic musical instrument shown in FIG. 1.

Referring to FIG. 5, the CPU 20 executes initialization processing in step 101. The initialization processing includes resetting of the rhythm run flag RUN, clearing of the key code buffers $KCBUF_0$ to $KCBUF_7$, zero-clearing of the mode register MODE, and the like.

The CPU 20 then executes loop processing consisting of decision processing in steps 110, 120, and 130, and "other processing" in step 140.

In steps 110 and 120, the CPU 20 checks the outputs from the switch group 50.

When the CPU 20 detects the on-event of the mode selection switch based on the outputs from the switch group 50, i.e., that the switch state is switched from the OFF to ON state in step 110, the flow branches to step 111, and the CPU 20 increments the data value of the mode register MODE within the range of 0 to 2. More specifically, the CPU 20 increments the data value from 0 to 1, 1 to 2, or 2 to 0. After step 111, the flow advances to step 120. If no on-event of the mode selection switch is detected in step 110, the flow directly advances from step 110 to step 120 without executing the processing in step 111.

The CPU 20 checks the outputs from the switch group 50 in step 120. If the CPU 20 detects the on-event of the start/stop switch, the CPU 20 inverts the rhythm run flag RUN in step 121, and it is then checked in step 122 if the flag RUN becomes "1" (or is set). If Y (YES) in step 122, the tempo clock TCLK is cleared in step 123 in order to start an automatic rhythm performance. Thereafter, the CPU 20 checks the sequencer mode MODE in step 124. If the play (MODE =1)or record (MODE =2) is detected, the address pointer PNT is set at a start address of a write or read area in the memory 30 in step 125 in order to start a write or read access with respect to the sequencer memory 30. The flow then advances to step 130. If the normal mode (MODE =0, manual performance mode) is determined in step 124, since neither write nor read access with respect to the sequencer memory 30 are performed, the flow skips the processing in step 125, and directly advances from step 124 to step 130.

If the CPU 20 determines in step 122 that the flag RUN is reset, the flow advances to step 126, and the CPU 20 executes key-off processing for all the tone generation channels of rhythm tones and accompaniment tones so as to stop automatic rhythm and accompaniment performance operations. The CPU 20 checks the sequencer mode MODE in step 127. If the mode MODE represents the record mode (MODE =2), the CPU 20 writes the end mark "$FE_H$" at a storage position SEQ(PNT) in the sequencer memory 30 designated by the pointer PNT and increments the pointer PNT in step 128. Thereafter, the flow advances to step 130. If the normal (MODE =0) or play (MODE =1) mode is determined in step 127, the flow skips the processing in step 128, and directly advances from step 127 to step 130.

If no on-event of the mode selection switch is detected in step 120, the flow directly advances from step 120 to step 130 without executing processing in steps 121 to 128.

In step 130, the CPU 20 checks the output from the keyboard circuit 10. If the CPU 20 determines in step 130 that no key-event is detected, the flow directly advances from step 130 to step 140; otherwise, the flow advances to step 131. In step 131, the CPU 20 checks the sequencer mode MODE. If the mode MODE represents the normal mode (MODE=0), the CPU 20 executes channel assignment (key assignment), and key-on/key-off processing of the corresponding channel in step 132. Thus, in the normal mode, musical tones can be generated as the keys are depressed. In step 133, the CPU 20 rewrites the key-on tone key code buffers $KCBUF_0$ to $KCBUF_7$ upon change by the channel assignment, and the flow then advances to step 140.

If the CPU 20 determines in step 131 that the record mode (MODE =2) is set, the CPU 20 executes channel assignment and rewriting of the buffers $KCBUF_0$ to $KCBUF_7$ in step 134. The CPU 20 detects a chord (chord type and root) based on the key codes stored in the buffers $KCBUF_0$ to $KCBUF_7$, and stores the detected chord in the chord name register CHD in step 135. In step 136, the CPU 20 sets the chord change flag CHDFLG, and the flow then advances to step 140.

If the CPU 20 determines in step 131 that the play mode (MODE =1) is set, the flow directly advances from step 131 to step 140 without executing processing in steps 132 to 136. Note that when the sequencer mode is the play or record mode (MODE =1 or 2), tones cannot be generated in accordance with actual key depression operations, and are generated as automatic accompaniment tones according to key-on tones and an accompaniment pattern (chord, bass, and the like).

In step 140, "other processing" such as rhythm selection, tone volume change, and the like, is executed. If a key-event is detected in the record mode (MODE =2), the event flag IVTFLG is set. The flow returns to step 110, and the processing in steps 110 to 140 is repeated.

2. Tempo Interruption Processing

Figure 6:
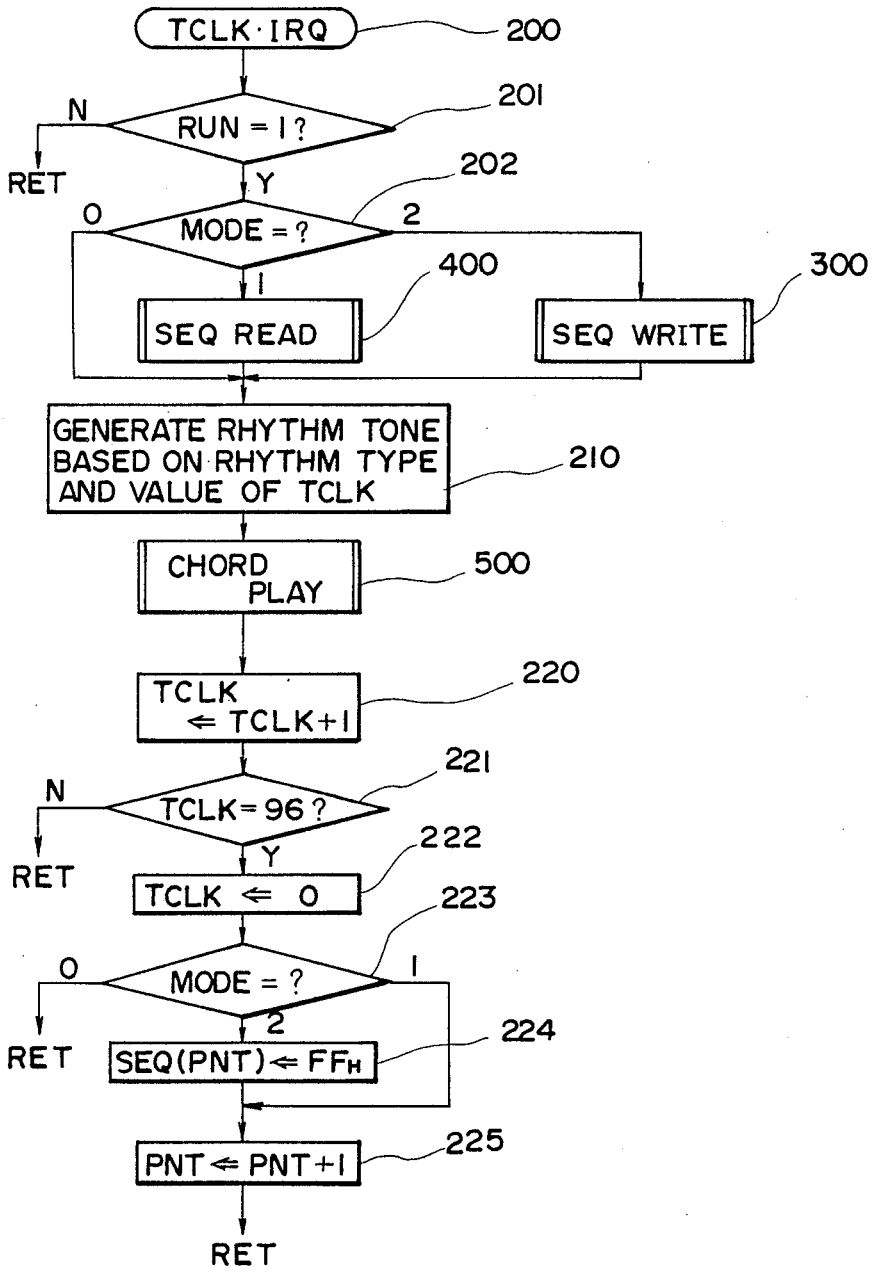
FIG. 6 is a flow chart of tempo interruption processing of the electronic musical instrument shown in FIG. 1.

In this electronic musical instrument, the CPU 20 executes the tempo interruption processing (step 200) shown in FIG. 6 using the clock pulse output every 1/96 period of one measure in quadruple time from the tempo clock generator 40.

Referring to FIG. 6, in step 201, the CPU 20 checks the rhythm run flag RUN. If the flag RUN is "0", the rhythm and accompaniment automatic performance operations are stopped, and tone generation processing of rhythm tones and accompaniment tones and count processing of the tempo clocks need not be performed. Therefore, interruption is immediately canceled, and the control recovers the main routine.

If the flag RUN is "1", the rhythm and accompaniment automatic performance operations are running. In this case, the CPU 20 discriminates the sequencer mode MODE in step 202. If the record mode (MODE =2) is set, the CPU 20 executes sequencer write processing in step 300 (FIG. 7), and then the flow advances to step 210. On the other hand, if the play mode (MODE =1) is set, the CPU 20 executes sequencer read processing in step 400 (FIG. 8), and the flow advances to step 210. Furthermore, if the normal mode (MODE =0) is set, the flow directly advances to step 210.

In step 210, the CPU 20 executes rhythm tone generation processing based on the rhythm number (rhythm type) RHY and the tempo clock TCLK. Subsequently, the CPU 20 executes chord tone generation processing in step 500 (FIG. 9, to be described later), and the flow then advances to step 220.

In step 220, the tempo clock TCLK is incremented, and the CPU 20 checks in step 221 if the value of the tempo clock TCLK becomes 96. If N (NO) in step 221, the interruption is canceled, and the control recovers the main routine. As described above, the tempo clock TCLK indicates a propression position of an automatic performance in one measure by a value varying between 0 and 95. When the tempo clock TCLK reaches 96, this means that one measure is completed. In this case, the tempo clock TCLK is cleared in step 222, and the sequencer mode MODE is checked in step 223. If the record mode (MODE =2) is set, the bar line "$FF_H$" is written at the storage position SEQ(PNT) of the sequencer memory 30 in step 224, and the pointer PNT is incremented in step 225. Thereafter, the control recovers the main routine. If the play mode (MODE =1) is set, the processing in step 224 is skipped, and pointer PNT increment processing in step 225 is executed. Thereafter, the interruption is canceled, and the control recovers the main routine. If the CPU 20 determines in step 223 that the normal mode (MODE =0) is selected, the interruption is canceled without any processing, and the control recovers the main routine from step 223.

3. Sequencer Write Processing

Figure 7:
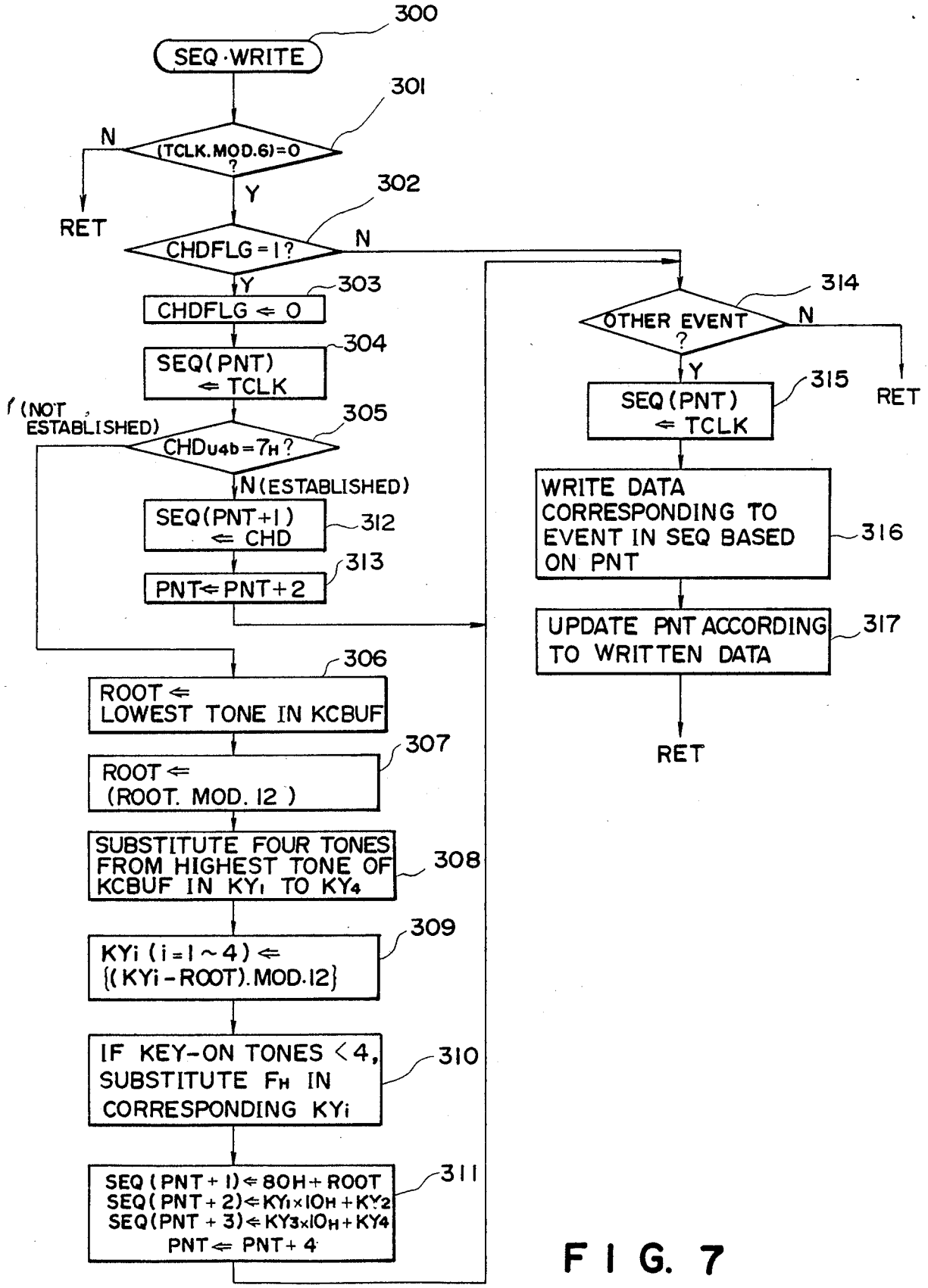
FIG. 7 is a flow chart of sequencer write processing of the electronic musical instrument shown in FIG. 1.

In the electronic musical instrument shown in FIG. 1, the CPU 20 executes the sequencer write processing shown in FIG. 7 every time the tempo interruption processing is executed in a performance data write state (RUN =1, MODE =2).

Referring to FIG. 7, the CPU 20 checks in step 301 if the value of the tempo clock TCLK corresponds to an integer multiple of 6. As described above, the sequencer memory 30 records/plays back performance data at a resolution of a sixteenth note, i.e., 6 tempo clocks TCLK. Therefore, if N in step 301, since the present timing is not a performance data write timing, the control returns to the previous processing (step 210 in FIG. 6). If Y in step 301, the present timing is the performance data write timing. In this case, the CPU 20 checks the chord change flag CHDFLG in step 302. If Y in step 302, the CPU 20 resets the flag CHDFLG in step 303, and writes tempo clock value TCLK as present timing data at a storage position SEQ(PNT) addressed by the pointer PNT of the sequencer memory 30 in step 304. Thereafter, the CPU 20 checks in step 305 if the upper 4 bits (chord type) of the chord name CHD stored in the processing of step 135 (FIG. 5) is "$7_H$".

Figure 3:
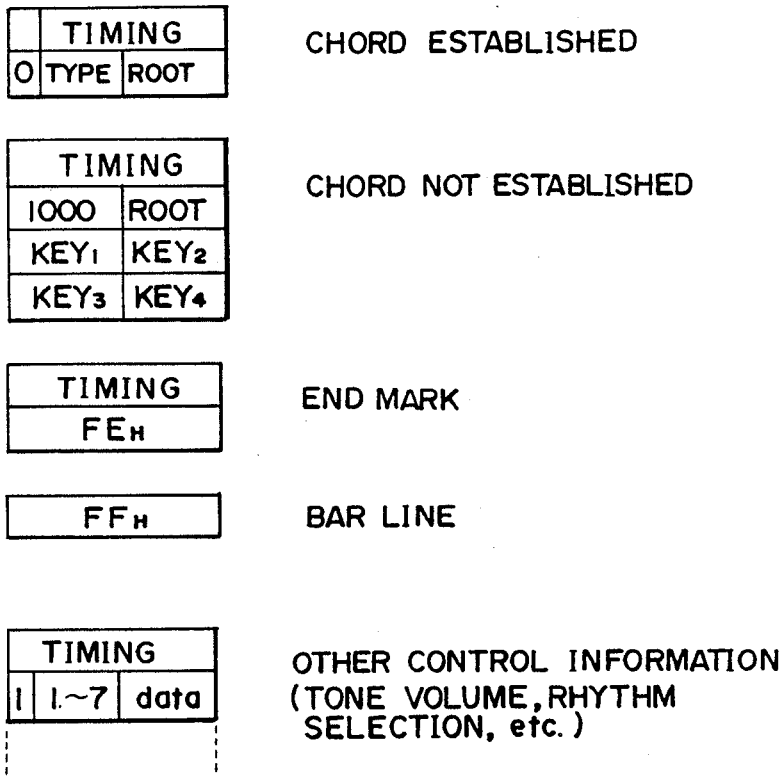
FIG. 3 shows performance pattern formats of a pattern memory shown in FIG. 1.

The chord type "$7_H$" represents a case wherein a chord cannot be established, that is, key-on tones are not discriminated as a chord in the processing of step 135. In this case, the flow advances to step 306, and the CPU 20 stores, as the root, the lowest tone of the key-on tones (key codes) written in the key-on tone key code buffers $KCBUF_0$ to $KCBUF_7$ in the processing of step 134 in the register ROOT. In step 307, the CPU 20 converts the root data (key code) ROOT into note data varying between 0 and 11. In step 308, the CPU 20 selects four tones from the high-tone side of the key-on tones $KCBUF_0$ to $KCBUF_7$, and stores the selected tones in the key code register $KY_1$ to $KY_4$. In step 309, the CPU 20 converts these key codes into values (0 to 11) within one octave, each representing a difference from the root ROOT in units of the number of half-tones. Step 310 is executed when the number of key-on tones is less than four. In step 310, the CPU 20 writes data "$F_H$" in a register $KY_i$ (i=1 to 4) which does not store a key-on tone in step 308. In step 311, the CPU 20 stores "$8_H$" in upper 4 bits of the storage position SEQ(PNT+1) and the value of the register ROOT in lower 4 bits, stores the values of the registers $KY_1$ to $KY_4$ in upper and lower 4 bits of a storage position SEQ(PNT+2) and in upper and lower 4 bits of a storage position SEQ(PNT+3), and increments the pointer PNT by four counts. Thereafter, the flow advances to step 314. With the processing in steps 304 to 311, the chord non-established state data shown in the format of FIG. 3 is recorded in the sequencer memory 30.

If the CPU 20 determines in step 305 that the chord can be established, the flow advances to step 312, and the CPU 20 stores the chord name data CHD at the storage position SEQ(PNT+1). In step 313, the pointer PNT is incremented by 2 counts, and the flow then advances to step 314. With the processing in steps 312 and 313, and in step 304, the chord established state data shown in the format of FIG. 3 is recorded in the sequencer memory 30.

If the CPU 20 determines in step 302 that the chord change flag CHDFLG is "0", this means that a chord is not changed although different keys are depressed. In this case, since the chord is not changed, chord data is not written. More specifically, the flow directly advances from step 302 to step 314 without executing the processing in steps 303 to 313.

In step 314, the CPU 20 checks the event flag IVTFLG to determine if another event occurs. If N in step 314, the control recovers the previous processing (step 210 in FIG. 6). If Y in step 314, the flow advances to step 315, and the CPU 20 writes the tempo clock value TCLK as the present timing data at the storage position SEQ(PNT) of the sequencer memory 30. In step 316, the CPU 20 writes data corresponding the event in the sequencer memory 30 based on the pointer PNT. In step 317, the CPU 20 increments the pointer PNT in accordance with the written data length, and the control then recovers the previous processing (step 210 in FIG. 6). With the processing in steps 315 to 317, other control information having the format shown in FIG. 3 is recorded in the sequencer memory 30.

Note that the end mark "$FE_H$" is recorded in the sequencer memory 30 in step 128 of the main routine processing (FIG. 5), and the bar line data "$FF_H$" is recorded therein in step 224 of the tempo interruption processing (FIG. 6).

4. Sequencer Read Processing

Figure 8:
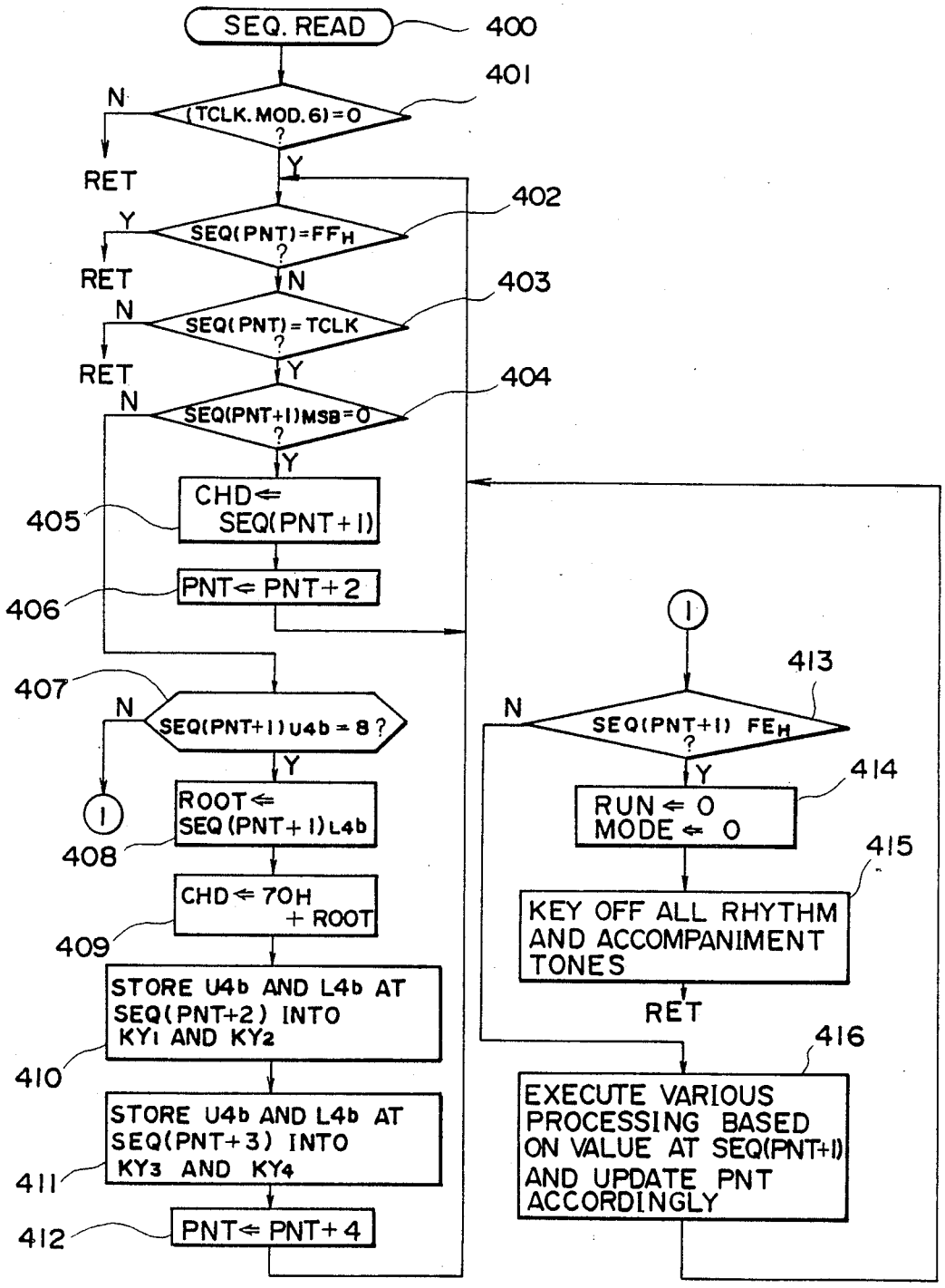
FIG. 8 is a flow chart of sequencer read processing of the electronic musical instrument shown in FIG. 1.

In the electronic musical instrument shown in FIG. 1, the CPU 20 executes sequencer read processing in FIG. 8 every time the tempo interruption processing (FIG. 6) is executed in a performance data read state (RUN =1, MODE =1).

Referring to FIG. 8, the CPU 20 checks in step 401 if the value of the tempo clock TCLK corresponds to the integer multiple of 6. As described above, the sequencer memory 30 records performance data at a resolution of the sixteenth note, i.e., six tempo clocks TCLK, and records a change content (event data) together with timing data only when the performance state is changed. The memory 30 plays back the performance data by reading out the event data in accordance with the timing. Therefore, if N in step 401, since the present timing cannot be a performance data read timing, the control recovers the previous processing (step 210 in FIG. 6). On the other hand, if Y in step 401, the present timing may be a performance data read timing. In this case, the CPU 20 checks data at the storage position SEQ(PNT) addressed by the pointer PNT in the sequencer memory 30 in steps 402 and 403. If the data is the bar line data "$FF_H$", the control recovers the previous processing (step 210 in FIG. 6) from step 402. If the data is different from the tempo clock value TCLK, since the present timing is not the performance data read timing, the control recovers the previous processing (step 310 in FIG. 6) from step 403. On the other hand, if the data is equal to the present tempo clock value TCLK, the present timing is the performance data read timing. In this case, the CPU 20 checks the MSB (most significant bit) of the data at the next storage position SEQ(PNT+1) in step 404. If the MSB of the second byte following the timing data is "0", the data is chord established state data. If the chord established state data is detected, the flow advances to step 405, and the CPU 20 reads out the chord name data from the storage position SEQ(PNT+1) and stores the readout data in the register CHD. In step 406, the CPU 20 increments the pointer PNT by two counts, and thereafter, the flow returns to step 402. On the other hand, if it is determined in step 404 that the MSB at the storage position SEQ(PNT+1) is "1", the flow advances to step 407 to check if the upper 4 bits at the storage position SEQ(PNT+1) represent "$8_H$". The data whose upper four bits represent "$8_H$" is chord non-established state data.

If the chord non-established state data is detected, the flow advances to step 408, and the CPU 20 reads out the root data from the lower four bits at the storage position SEQ(PNT+1) and stores it in the register ROOT. In step 409, the CPU 20 generates chord name data in which the upper 4 bits represent the chord non-established state data "$7_H$" and lower four bits represent the root data ROOT, and stores the generated data in the register CHD. In step 410, the CPU 20 stores the upper and lower 4 bits at the storage position SEQ(PNT+2) in the key code registers $KY_1$ and $KY_2$, respectively, and stores the upper and lower 4 bits at the storage position SEQ(PNT+3) in the key code registers $KY_3$ and $KY_4$, respectively, in step 411. Furthermore, the CPU 20 increments the pointer PNT by four counts in step 412, and the flow then returns to step 402.

If it is determined in step 407 that the upper 4 bits at the storage position SEQ(PNT+1) do not represent "$8_H$", data stored therein is the end mark data or other information. In this case, the flow advances to step 413 to check if data at the storage position SEQ(PNT+1) is the end mark "$FE_H$". If Y in step 413, the CPU 20 clears the rhythm run flag RUN and zero-clears the mode register in step 414. In step 415, the CPU 20 executes all key-off processing of the rhythm and accompaniment tones, and the control then recovers the previous processing (step 210 in FIG. 6). Thus, the automatic performance is completed, and the sequencer mode is reset to the normal mode (MODE =0).

If it is determined in step 413 that data at the storage position SEQ(PNT+1) is not the end mark "$FE_H$", since the data is other information, various processing based on the value at the storage position SEQ(PNT+1) is executed and the pointer PNT is incremented according to the data length in step 416. Thereafter, the flow returns to step 402, and the processing in steps 402 to 416 is repeated.

5. Chord Tone Generation Processing

Figure 9:
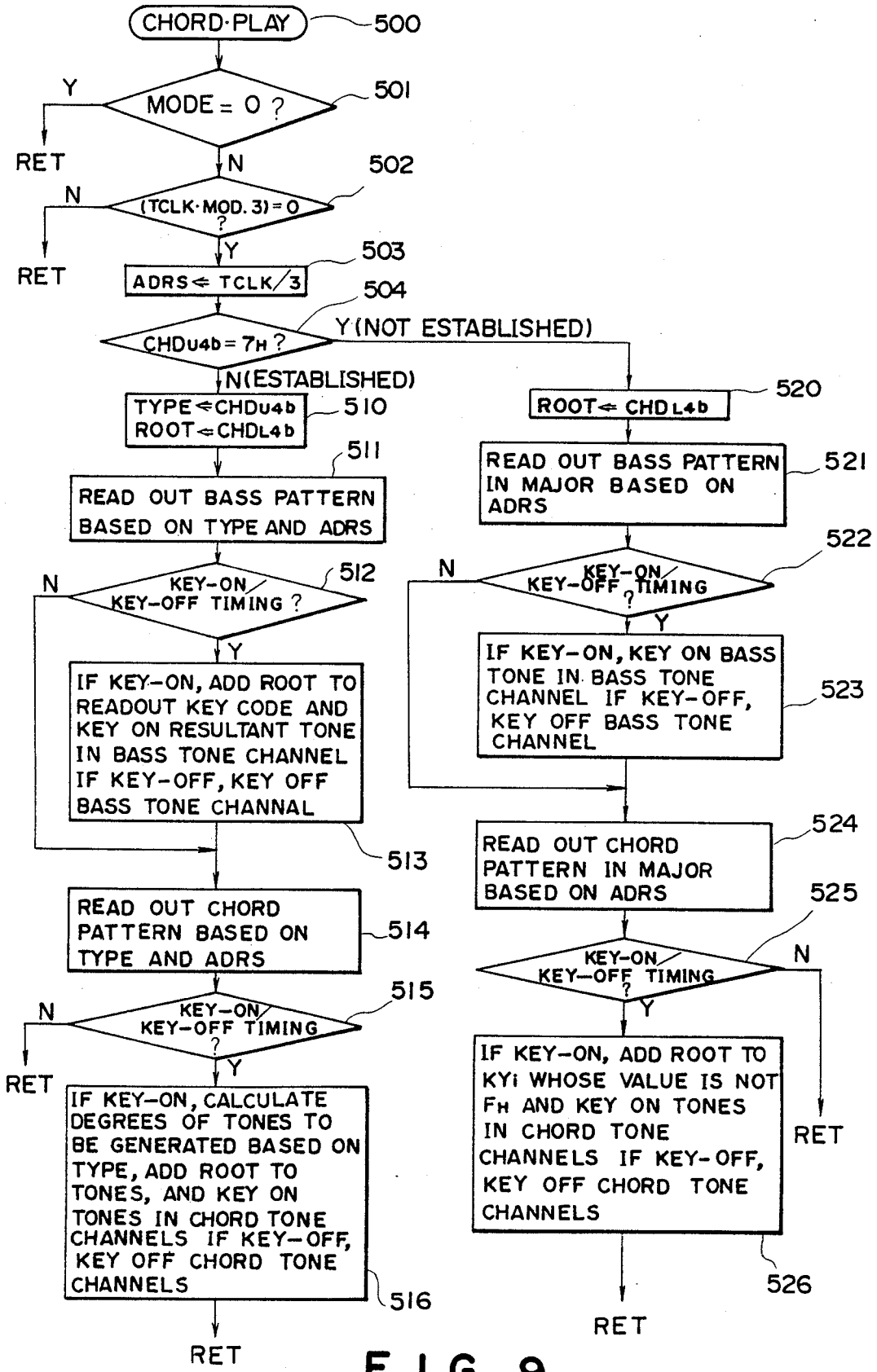
FIG. 9 is a flow chart of chord tone generation processing of the electronic musical instrument shown in FIG. 1.

In the electronic musical instrument shown in FIG. 1, the CPU 20 executes chord tone generation processing shown in FIG. 9 when the rhythm runs (RUN =1) in the record or play mode (MODE =1 or 2).

Referring to FIG. 9, in step 501, the CPU 20 checks the sequencer mode MODE. If the mode indicates a sequencer OFF mode (MODE =0), i.e., the normal (manual performance) mode is set, the automatic performance of chord tones is interrupted, and the tone generation processing of chord tones is unnecessary. The control immediately recovers the previous processing (step 220 in FIG. 6).

If the mode indicates a sequencer ON mode, i.e., the record or play mode (MODE =1 or 2) is set, the CPU 20 checks in step 502 if the value of the tempo clock TCLK is an integer multiple of 3. As described above, the pattern memory 32 records accompaniment pattern data at a resolution of the thirty-second note, i.e., three tempo clocks TCLK. Therefore, if the value of the tempo clock TCLK is not an integer multiple of 3, since the present timing is not an accompaniment pattern read timing, the control immediately recovers the previous processing (step 220 in FIG. 6). On the other hand, if it is determined in step 502 that the value of the tempo clock TCLK is an integer multiple of 3, the present timing is the accompaniment pattern read timing. In this case, the CPU 20 sets the accompaniment pattern read address pointer ADRS to be TCLK/3 in step 503, and checks in step 504 if the upper 4 bits of the register CHD represent "$7_H$". The register CHD stores data in step 135 (in the record mode) of the main routine processing (FIG. 5) or step 405 or 409 (in the play mode) of the sequencer read processing (FIG. 8). If the upper 4 bits of the register CHD represent data other than "$7_H$", i.e., if the chord can be established, the flow advances to step 510; otherwise, the flow advances to step 520.

If the chord is established, the flow advances to step 510, and the chord type data corresponding to the upper 4 bits of the register CHD is stored in the register TYPE, and the root data corresponding to the lower 4 bits of the register CHD is stored in the register ROOT. In step 511, the CPU 20 reads out a bass pattern based on the chord type TYPE and the timing ADRS, and the CPU 20 checks in step 512 if the bass tone of interest is at a key-on or key-off timing. As described above, the bass pattern data represents a key code (pitch) of a bass tone at each timing ADRS. Thus, if data is switched from "0" (rest) to a value other than "0", the data represents the key-on timing, and if data is switched from a value other than "0" to "0", the data represents the key-off timing. If the bass tone of interest is at the key-on timing, the root data ROOT is added to the bass tone of interest and the corresponding tone is keyed on in the bass tone channel of the tone generator 60. Thereafter, the flow advances to step 514. If the bass tone of interest is at the key-off timing, the corresponding tone is keyed off in the bass tone channel in step 513, and the flow advances to step 514. If the bass tone of interest is at neither the key-on nor key-off timings, the flow directly advances from step 512 to step 514.

In step 514, the CPU 20 reads out a chord pattern based on the chord type TYPE and the timing ADRS, and thereafter, checks in step 515 if the chord tone of interest is at a key-on or key-off timing. As described above, the chord pattern data represents whether the chord tone of interest is being subjected to tone generation ("1") or not ("0") at the timing ADRS. If data is switched from "0" to "1", the tone of interest is at the key-on timing, and if data is switched from "1" to "0", the tone of interest is at the key-off timing. If the tone is at the key-on timing, the CPU 20 calculates the degrees of tones constituting the chord based on the chord type TYPE, and adds the root data ROOT to the calculated degrees to obtain key codes of the tones constituting the chord in step 516. Thus, the corresponding tones are generated in the chord tone channels of the tone generator 60, and the control recovers the previous processing (step 220 in FIG. 6). If the tone of interest is at the key-off timing, the tones are keyed off, and the control recovers the previous processing (step 220 in FIG. 6).

If it is determined in step 504 that a chord cannot be established, the flow advances to step 520, and the root data corresponding to the lower 4 bits of the register CHD is stored in the register ROOT. In step 521, a bass pattern in major is read out based on the timing ADRS. The CPU 20 then checks in step 522 if the bass tone of interest is at the key-on or key-off timing. If the tone is at the key-on timing, the root ROOT is generated in the bass tone channel of the tone generator 60, and the flow advances to step 524. If the tone is at the key-off timing, the bass tone channel is keyed off in step 523, the flow advances to step 524. If the tone is at neither the key-on nor key-off timings, the flow directly advances from step 522 to step 524.

In step 524, the CPU 20 reads out the chord pattern based on the timing ADRS, and checks in step 525 if the chord tone is at the key-on or -key-off timing. If the tone is at the key-on timing, the root data ROOT is added to the register $KY_i$ (i=1 to 4) whose value is not "$F_H$", and the chord tones are generated in the chord tone channels of the tone generator 60. Thereafter, the control recovers the previous processing (step 220 in FIG. 6). If the tone is at the key-off timing, the chord tone channels are keyed off in step 526, and the control recovers the previous processing (step 220 in FIG. 6).

The present invention is not limited to the above embodiment, and various changes and modifications may be made within the spirit and scope of the invention.

1. A melody key range can be added.
2. The sequencer play/record mode can be started synchronous with a key depression.
3. The resolution and time of the tempo clock are not limited to those in the above embodiment.
4. In the above description, when a chord cannot be established, key-on information to be stored is a relative pitch rounded to note information corresponding to the root, but may be a key code as it is. In this case, a key-on pitch can be accurately played back. The number of key-on information to be stored can be arbitrarily set.
5. In the above description, an accompaniment pattern when a chord cannot be established employs one in major. However, an accompaniment pattern exclusively used when a chord cannot be established may be prepared.
6. An accompaniment pattern is not limited to chord and bass patterns. For example, accompaniment using a broken chord, e.g., arpeggio or an accompaniment pattern in which intervals of a chord are appropriately shifted or changed may be employed.

What is claimed is:

1. An automatic performance apparatus for an electronic musical instrument, comprising:

input means for designating tone information including pitch information;

mode selection means for selecting one of a record mode and a play mode, wherein said modes represent controlling states;

chord detection means for, when the mode selection means has selected a record mode, discriminating based on pitch information outputted from said input means whether or not a chord is established, and for, when a cord is established, generating chord information;

storage means for storing chord information and tone information;

writing means for, when a chord is established in a record mode, writing chord information in said storage means, and for, when a chord is not established in a record mode, writing tone information in said storage means; and reading means for, in a play mode, reading out the information written in said storage means so as to control generation of tones.

2. An automatic performance apparatus according to claim 1, wherein said input means is a keyboard.

3. An automatic performance apparatus according to claim 2, wherein said tone information includes at least one of key-on information from said keyboard and information of only a note portion of key-on information from said keyboard excluding octave information.

* * * * *